United States Patent [19]

Yamauchi

[11] Patent Number: 4,641,483

[45] Date of Patent: Feb. 10, 1987

[54] CONTAINER HOLDER FITTING DEVICE

[76] Inventor: Warren Yamauchi, 16326 Rainbow Ridge Rd., Carbon Canyon, Calif. 91710

[21] Appl. No.: 773,375

[22] Filed: Sep. 6, 1985

[51] Int. Cl.[4] ..... B65B 27/04

[52] U.S. Cl. ..... 53/390; 53/48; 53/398

[58] Field of Search ..... 53/390, 398, 48

[56] References Cited

U.S. PATENT DOCUMENTS

| | | | |
|---|---|---|---|
| 2,929,181 | 3/1960 | Poupitch | 53/48 |
| 3,156,971 | 11/1964 | Shazor | 53/48 |
| 3,224,575 | 12/1965 | Whiteford | 53/48 |
| 4,242,853 | 1/1981 | Roetgerink | 53/398 |
| 4,505,089 | 3/1985 | Osteen | 53/48 |
| 4,545,173 | 10/1985 | Hartness et al. | 53/48 |

FOREIGN PATENT DOCUMENTS

| | | | |
|---|---|---|---|
| 617479 | 4/1961 | Canada | 53/48 |

*Primary Examiner*—John Sipos
*Assistant Examiner*—Donald H. Studebaker
*Attorney, Agent, or Firm*—Limbach, Limbach & Sutton

[57] ABSTRACT

A device for manually and simultaneously forcing four, contoured, flexible, six pack type holders over the necks of twenty-four bottles. The device includes a pair of parallel, spaced apart pipes to which a plurality of parallel, spaced apart cross bars are perpendicularly attached, with the cross bars and pipes each having downwardly extending legs at their ends which engage with the shoulders of the holders. A pair of handles are attached to the pipes to allow the user to exert a downward force on the pipes and, through the legs of the cross bars and pipes, to the shoulders of the holders. The cross bar legs are dimensioned so that the cross bars are also in contact with the tops of the holders at the same time that the legs engage the shoulders thereby ensuring that the downward force applied by the operator is evenly distributed over the holder.

11 Claims, 4 Drawing Figures

CONTAINER HOLDER FITTING DEVICE

TECHNICAL FIELD

The present invention relates generally to a device for fitting a container holder over a plurality of containers, and more specifically to a device for fitting a flexible bottle holder over a group of bottles.

BACKROUND OF THE INVENTION

Many beverages, such as sodas and beer, are available for purchase in individiual portion sized containers, typically containing ten to twelve ounces of beverage. These individual portion containers are available for purchase either singly or in groups, typically in groups of six and commonly referred to as "six packs". Such containers include the ever popular aluminum can and glass bottle, both of which are available in individual portion sizes. The beverage containers tend to be of roughly uniform configuration. Bottles, for example, all have a cylindrical lower body portion which tapers up toward a slender upper neck portion with an opening of a relatively small diameter.

When these beverage containers are sold in groups, it is desirable that they be physically attached to one another to facilitate handling, such as in groups of six, by means of a single bottle holder having an opening for each of the six bottles. Commonly used bottle holders are comprised of a flexible material, such as a plastic, and have contoured configurations corresponding to the outer configuration of the upper portions of the group of bottles to which they will be attached. In use, the bottle holder is fitted over the group of bottles such that each of their tapered neck portions jut through each holder opening.

This fitting is accomplished by spatially arranging a group of bottles such that each bottle top rests under a holder opening. Physical pressure is then applied to the bottle holder which is forced down and over the bottle tops. The openings are usually of dimensions such as to fit snugly and tightly over the tapered neck portions of the bottles to secure the position of the bottles within the openings once fitted. The openings are further usually spaced apart from one another such that the lower body portions of the bottles are near, if not touching, one another. The bottle holders known in the art also include means for gripping the group of bottles contained within them. Typically, such gripping means comprises further openings within the holder through which the customer's fingers can grip the holder and the attached bottles.

Despite the advantages offered by these bottle holders, they present certain disadvantages to the small scale bottler or distributor who must fit the holder to the bottles. The process of fitting the bottle holder over the bottle tops can be carried out manually, with the operator fitting a single holder over a single group of, typically six, bottles at a time or by the use of very expensive automated equipment. Because of the high purchase and maintenance costs of such equipment, efficient manual operation can be cost effective, especially for a small scale bottler or distributor.

The manual process is further lengthened by the requirement that the bottles be spatially arranged prior to fitting such that each holder opening rests upon each bottle top. Further, because the holder openings fit snugly and tightly about the upper neck portion of the bottles, they are sometimes difficult to fit over the bottles. The need for human operation and consumption of time required to properly fit these bottle holders over a group of bottles results in costly inefficiencies and renders them burdensome to use despite their advantages. Thus, there is a need to provide a degree of low cost automation to the process of fitting bottle holders over bottles. This need is met with the present invention.

It is, therefore, an object of the present invention to provide a container holder fitting device which increases a worker's efficiency in manually fitting container holders over a plurality of containers.

It is another object of the present invention to provide a mechanically reliable device for fitting bottle holders over a plurality of bottles.

It is yet a further object of the present invention to provide a manually operated bottle holder fitting device capable of simultaneously fitting a bottle holder over a plurality of six packs.

SUMMARY OF THE INVENTION

The above and other problems in trying to efficiently force a flexible, contoured holder over the necks of a predetermined arrangement of such containers, the holder being of the type having shoulders and openings for receiving the necks of the containers, are overcome by the device of the present invention which comprises a pair of pipes arranged parallel to, and spaced apart from each other, a plurality of cross bars connected perpendicularly to the pipes and arranged parallel to, and spaced apart from each other, and a pair of handles connected to the pipes for manually applying a downward force to the pipes. Each of the cross bars has a downwardly extending leg at each end for engagement with a corresponding shoulder of the holder. In the preferred embodiment the pipes are hollow and rectangular in cross-section.

The length of each leg of the cross bars is selected to match the height of the top of the holder above the shoulder so that the cross bars bear against the top of the holder simultaneously as the legs contact the shoulders of the holder. Each pipe also has a downwardly extending leg at each end for engaging a shoulder of the holder. The lengths of the pipe legs are selected to equal the height of the top of the holder above the shoulder engaged by the pipe leg.

In the preferred embodiment, the length of the pipes is selected to straddle six containers placed side by side in a line and the length of the cross bars is selected to extend between the two outside shoulders of two holders when placed side by side. The preferred embodiment of the device includes a first and a second pair of cross bars, with the cross bars of each pair being spaced apart from each other by approximately the width of a single container and the first and second pairs of cross bars being spaced apart from each other by approximately twice the width of a container, with the first and second pairs of cross bars being attached to the pairs of pipes at points which are spaced inwardly from the ends of the pipes by a distance which is approximately equal to the width of a container. This enables the device to straddle four six pack type container holders arranged side by side in a standard, twenty-four container, rectangularly shaped shipping carton of the type having upright walls, with the pipe legs and the cross bar legs engaging the holder shoulders which are immediately adjacent the walls of the carton.

Each cross bar leg in the preferred embodiment is comprised of a flat, metal strap which is welded perpendicularly to the end of the cross bar, is bent at an acute angle at its upper end and is welded at such upper end to one of the pipes.

The handles are preferably circular in cross-section to minimize the possibility of injury to a user's hands and are directly attached to both pipes.

The invention is described below in greater detail with reference to the accompanying drawings which depict different views of an embodiment of the present invention.

BEST MODE FOR CARRYING OUT THE INVENTION

Although it will be obvious that the present invention may accomodate any number of container holders, each of which may accomodate any number of containers, the invention will be decribed in detail with reference to the embodiment illustrated in the accompanying drawings.

In the illustrated embodiment, each container holder accomodates six containers arranged side by side in a line. Four such container holders are also arranged side by side in a line so that each is in contact with two other holders. Thus, the device of the illustrated embodiment may fit a group of four holders over a total of twenty-four containers. This arrangement of twenty-four containers is appropriate for use in the standard rectangularly shaped shipping carton of the type having upright walls wherein the holders are immediately adjacent to the walls of the carton.

Figure 1:
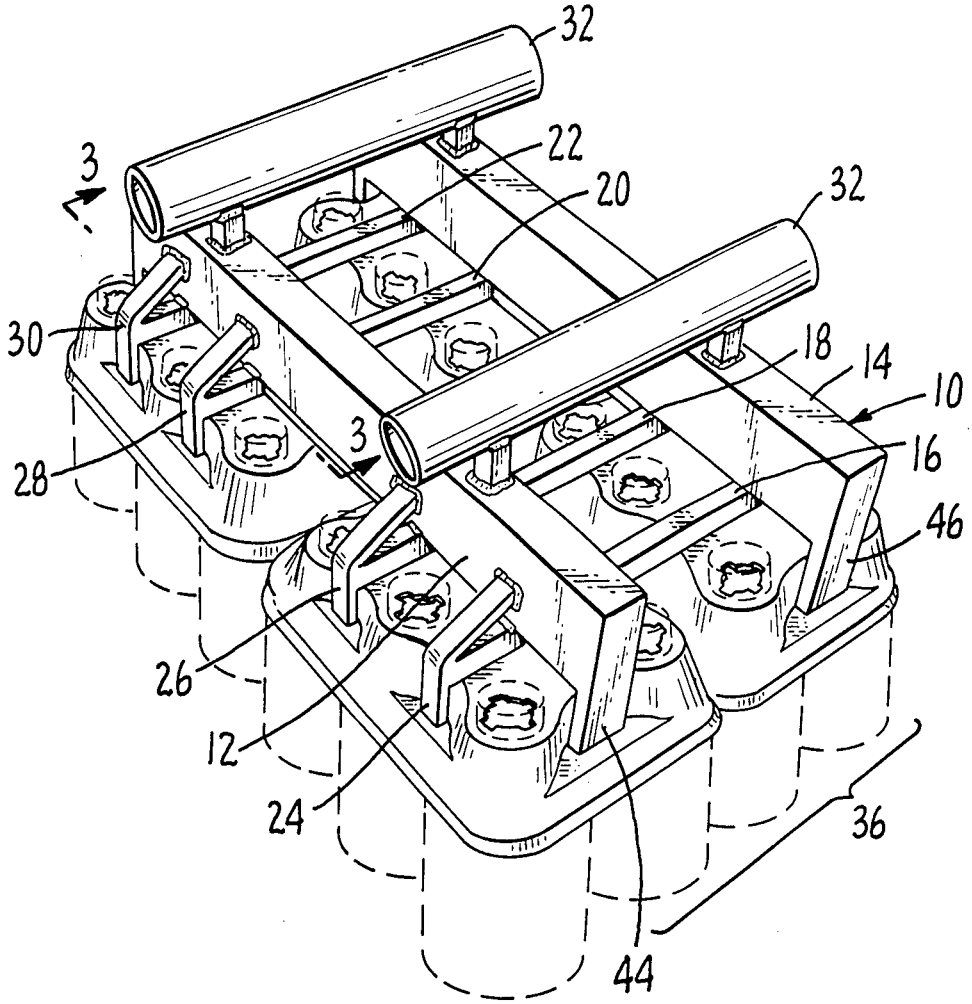
FIG. 1 is a perspective view of a device of the present invention in use.

A device of the present invention is shown generally in the drawings as reference numeral 10. As shown in FIG. 1, the device generally comprises a pair of pipes, 12 and 14, which are parallel to and spaced apart from one another. A plurality of cross bars, which are spaced apart from and parallel to one another, are perpendicularly connected to pipes 12 and 14. The illustrated embodiment of FIG. 1 is comprised of two pairs of such cross bars, 16, 18, 20 and 22. Each cross bar is symetrical and includes one member of a pair of downwardly extending legs, 24, 26, 28 and 30, respectively, on each of its ends. As can be appreciated, the number of cross bars may vary depending upon the number of containers and container holders the device will be used with. The device also includes handle means 32, attached to both pipes 12 and 14 and extending between them, for manually applying a downward force to pipes 12 and 14.

Figure 2:
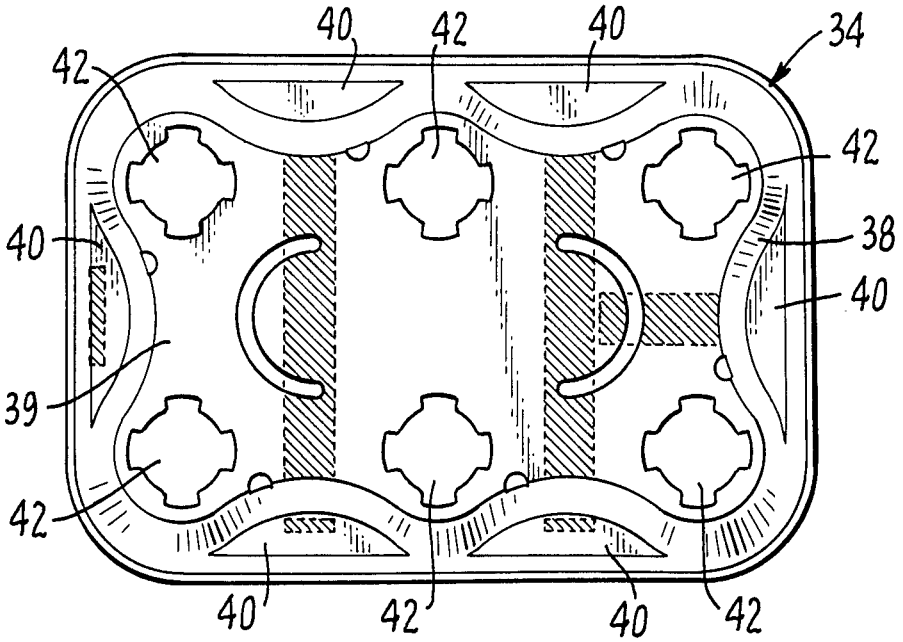
FIG. 2 is a top plan view of a typical container holder with which the device of the present invention is used.
Figure 3:
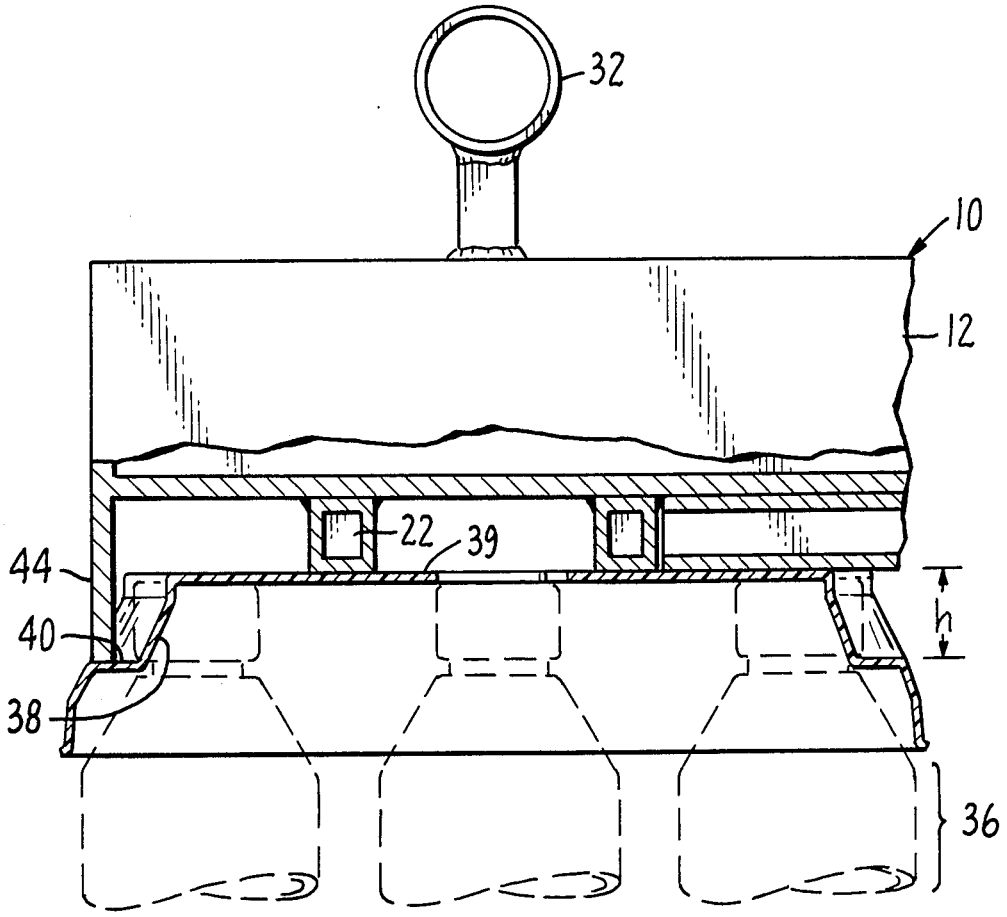
FIG. 3 is a partial cross sectional view of the device shown in FIG. 1 along line 3—3 wherein the device is in the prefitted position.
Figure 4:
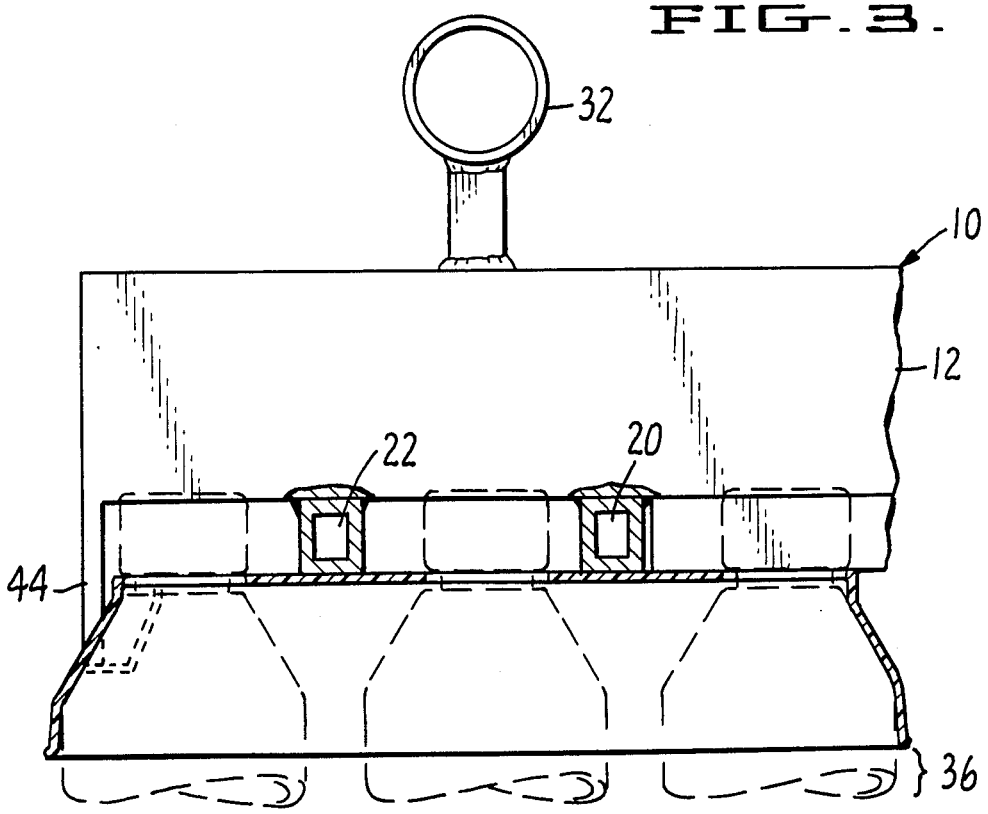
FIG. 4 is a is a partial side view of a device of the present invention wherein the device is in the fitted position.

A typical container holder is shown in the drawings, particularly FIG. 2, as reference numeral 34. Holder 34 has a contoured configuration corresponding to the configuration of the upper portions of a group of containers shown collectively as 36 over which it will be fitted. Referring to FIG. 2, holder 34 also includes a raised ridge portion 38 defining a peripheral portion and an inner top portion 39 of said holder, a plurality of shoulders shown collectively as 40 within the peripheral portion, and a plurality of apertures shown collectively as 42 within the inner top portion 39 for receiving the the neck portions of containers 36 upon assembly. Ridge 38 rises over shoulders 40 by a height h (see FIG. 3). The number of apertures 42 present on any container holder should correspond with the number of containers to be held.

In operation, holders 34 are placed over a predetermined arrangement of containers, such as a rectangular arrangement, such that the top portions of containers 36 lie beneath apertures 42. The device 10 is then placed over the combination of containers and holders such that each member of downwardly extending leg pairs 24, 26, 28 and 30 physically engages with a holder shoulder 40 located on the outside of the group of holders as shown is FIG. 3. Cross bars legs 24, 26, 28 and 30 should be dimensioned such that cross bars 16, 18, 20 and 22 physically engage with the tops 39 of holders 32 simultaneously as leg pairs 24, 26, 28 and 30 contact the outer shoulders 40 of holders 34 to ensure that contact with the device 10 is distributed evenly over the holders 34. An operator, grasping the handles 32, next applies a downward force which is transmitted through the device 10 to the tops 39 and shoulders 40 of the holders 34. Thus, holders 34 are forced down and over the neck portions of containers 36 and the neck portions are made to protrude through apertures 42.

The length of each member of downwardly extending leg pairs 24, 26, 28 and 30 attached to cross bars 16, 18, 20 and 22, respectively, should be of a length approximately corresponding to height h in order for the force to be evenly distributed between the top portion 39 and the shoulders 40. Uneven application of this force will cause the holder to change shape and to fit incorrectly over the bottles, resulting in dropped and broken bottles when the six packs are picked up.

In a preferred embodiment, each cross bar leg 24–30, inclusive, is comprised of a flat, metal strap which is connected perpendicularly to the end of the cross bar 16–22, inclusive, to which it is attached. As shown in FIG. 1, the cross bar legs may be bent at an acute angle at their upper ends and connected at such upper ends to pipes 12 or 14 for reinforcement. In the illustrated embodiment, cross bars 16, 18, 20 and 22 are of a length such as to extend between the two outside shoulders 40 of two holders 34 when placed side by side.

In a preferred embodiment, pipes 12 and 14 each have a pair of downwardly extending legs 44 and 46, respectively, to engage an outer holder shoulder during the fitting operation. Each leg 44 and 46 should be of a length approximately equal to height h for even force application. Pipes 12 and 14 can be hollow and have a rectangluar cross section. In the illustrated embodiment, pipes 12 and 14 are of lengths such as to straddle six containers placed side by side in a line.

To aid in the process of manually applying a downward force onto the device, handle means 32 is preferably comprised of a pair of handles directly attached to pipes 12 and 14 as shown in FIG. 1. The handles should preferably have a circular cross section to reduce the possibility of injury to the user's hands and be hollow to reduce the weight of the device and maintain its portability.

Use of the device thus described is an advantage over the prior known manual method of fitting a single holder over a single group of containers. The device, being simple and inexpensive to construct, provides a degree of low cost automation to the process of fitting container holders over containers.

Although the foregoing invention has been described in some detail by way of illustration and example for purposes of clarity understanding, it will be obvious that certain changes and modifications may be practiced within the scope of the appended claims.

What is claimed is:

1. A device for forcing a flexible, contoured holder over the necks of a predetermined arrangement of containers, the holder being of the type having a first flat upper surface, openings for receiving the necks of the containers and shoulders spaced along its periphery, each shoulder having a second flat upper surface below and parallel with the first flat upper surface, the device comprising:

a pair of horizontal pipes arranged parallel to, and spaced apart from each other, a plurality of cross bars connected perpendicularly to the pipes and arranged parallel to, and spaced apart from each other, each of the cross bars having a downwardly extending leg at each end for engagement with a corresponding shoulder of the holder, each downwardly extending leg having a length approximately equal to the vertical distance between the first and second surfaces whereby the cross bars bear against the first surface while the downwardly extending legs bear against the second surface of the holder, and handle means for manually applying a downward force to the pipes.

2. A container holder fitting device as recited in claim 1 wherein the pipes are hollow and rectangular in cross-section.

3. A container holder fitting device as recited in claim 1 wherein each pipe also has a downwardly extending leg at each end for engaging a shoulder of the holder.

4. A container holder fitting device as recited in claim 3 wherein the lengths of the pipe legs are selected to equal the height of the top of the holder above the shoulder engaged by the pipe leg.

5. A container holder fitting device as recited in claim 1 wherein the length of the pipes is selected to straddle six containers placed side by side in a line.

6. A container holder fitting device as recited in claims 1 or 5 wherein the length of the cross bars is selected to extend between the two outside shoulders of two holders when placed side by side.

7. A container holder fitting device as recited in claim 1 wherein the device comprises a first and a second pair of cross bars, with the cross bars of each pair being spaced apart from each other by approximately the width of a single container and the first and second pairs of cross bars being spaced apart from each other by approximately twice the width of a container, with the first and second pairs of cross bars being attached to the pairs of pipes at points which are spaced inwardly from the ends of the pipes by a distance which is approximately equal to the width of a container, whereby the device is capable of straddling four six pack type container holders arranged side by side in a standard, twenty-four container, rectangularly shaped shipping carton of the type having upright walls, with the pipe legs and the cross bar legs engaging the holder shoulders which are immediately adjacent the walls of the carton.

8. A container holder fitting device as recited in claim 1 wherein each cross bar leg is comprised of flat, metal strap which is connected perpendicularly to the end of the cross bar, is bent at an acute angle at its upper end and is connected at such upper end to one of the pipes.

9. A container holder fitting device as recited in claim 1 wherein said handle means comprises a pair of handles connected to the pipes.

10. A container holder fitting device as recited in claim 9 wherein the handles are directly attached to both pipes.

11. A container holder fitting device as recited in claim 9 wherein the handles are circular in cross-section.

* * * * *